United States Patent [19]

Miller

[11] 4,339,645

[45] Jul. 13, 1982

[54] RF HEATING COIL CONSTRUCTION FOR STACK OF SUSCEPTORS

[75] Inventor: Edward A. Miller, Morrisville, Pa.

[73] Assignee: RCA Corporation, New York, N.Y.

[21] Appl. No.: 165,740

[22] Filed: Jul. 3, 1980

[51] Int. Cl.[3] ..... H05B 6/40; C23C 13/08

[52] U.S. Cl. ..... 219/10.49 R; 219/10.43; 219/10.79; 118/725; 118/730; 118/50.1; 118/620; 427/45.1; 148/174

[58] Field of Search ..... 219/10.49 R, 10.57, 219/10.79, 10.43, 10.67; 118/725, 728–733, 50, 50.1, 620; 427/45.1, 46, 47; 148/174, 175

[56] References Cited

U.S. PATENT DOCUMENTS

| | | | |
|---|---|---|---|
| 2,469,640 | 5/1949 | Gillespie | 219/10.79 X |
| 3,031,555 | 4/1962 | Ross et al. | 219/10.79 |
| 3,212,858 | 10/1965 | Smith et al. | 219/10.49 X |
| 3,539,759 | 11/1970 | Spiro et al. | 219/10.49 R |
| 3,549,847 | 12/1970 | Clark et al. | 219/10.49 R |
| 3,699,298 | 10/1972 | Briody | 219/10.49 R |
| 3,845,738 | 11/1974 | Berkman et al. | 219/10.49 X |
| 3,980,854 | 9/1976 | Berkman et al. | 219/10.49 R |
| 4,062,318 | 12/1977 | Ban et al. | 118/725 |
| 4,112,285 | 9/1978 | Pan et al. | 219/10.79 X |

FOREIGN PATENT DOCUMENTS

| | | | |
|---|---|---|---|
| 2157135 | 5/1973 | Fed. Rep. of Germany | 118/728 |
| 2201142 | 7/1973 | Fed. Rep. of Germany | 118/728 |

OTHER PUBLICATIONS

Journal of Crystal Growth, "Novel Reactor for High Volume Low-Cost Silicon Epitaxy", V. S. Ban, vol. 45 (1978), pp. 97–107.

*Primary Examiner*—B. A. Reynolds
*Assistant Examiner*—Philip H. Leung
*Attorney, Agent, or Firm*—Samuel Cohen; William Squire

[57] ABSTRACT

Arrangement for RF heating a stack of disc-like susceptor elements lying in parallel planes in which a coil surrounding the elements creates the RF field. The coil comprises a plurality of turns which are saddle-shaped and oriented so that a turn generates a field which inductively heats at least two of the susceptor elements and so that most elements are heated by fields created by at least two turns.

6 Claims, 1 Drawing Figure

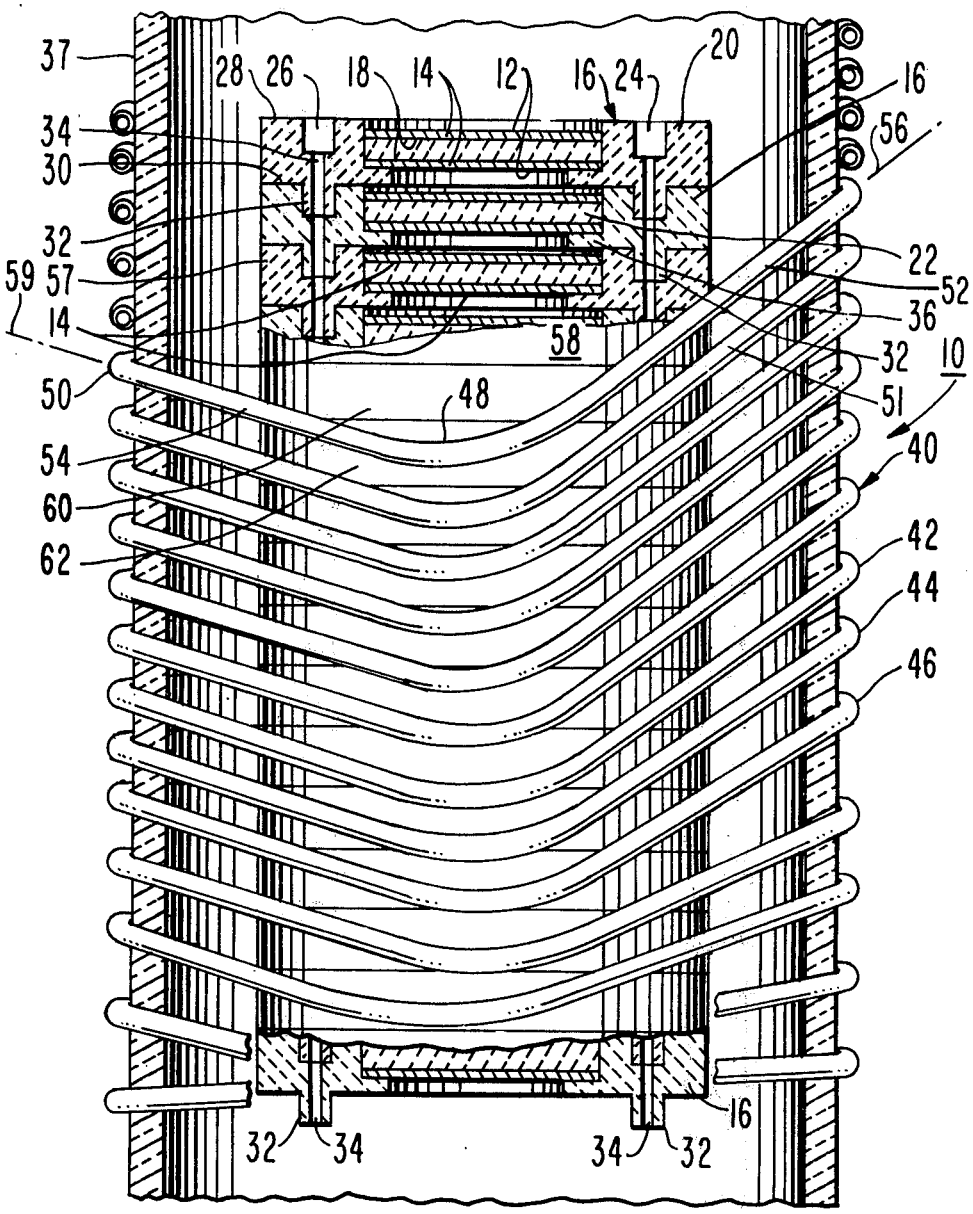
37
28
26
18
14
12
16
24
20
16
34
30
56
32
22
59
57
52
14
36
58
32
10
50
48
51
54
40
60
42
62
44
46
16
32
34
34
32

RF HEATING COIL CONSTRUCTION FOR STACK OF SUSCEPTORS

The present invention relates to an improved coil construction especially suitable for inductively heating susceptors used to hold substrates onto which material is to be vapor deposited.

Chemical vapor deposition (CVD) is a method of forming a layer of material on a substrate, such as an epitaxial layer on a silicon wafer, wherein deposits are produced by heterogeneous gas-solid or gas-liquid chemical reactions at the surface of the substrate. A volatile compound of the element or substance to be deposited is introduced and thermally decomposed or reacted with other gases or vapors, at the surface of the substrate to yield non-volatile reaction products which deposit on the substrate surface. Chemical vapor-deposition processes involving silicon wafers are typically performed at high temperatures in reaction chambers wherein the wafers are supported and heated on graphite susceptors.

A particular susceptor construction is disclosed in U.S. Pat. No. 4,062,318, which is incorporated by reference herein. That apparatus for chemically vapor-depositing material onto surfaces of a substrate within a reaction chamber comprises a cylindrical quartz tube. The apparatus further comprises means positioned within that chamber for supporting substrates in a stack-like relationship and whose surfaces are spaced substantially parallel to each other. The supporting means comprises a plurality of plate-shaped susceptors positioned so that the major surfaces of the susceptors are substantially parallel and spaced from each other in a stack-like arrangement. Each susceptor has two substrates mounted thereon, one on each major surface. The substrates are held adjacent the susceptors by a suitable holding means, such as circular means, which fit over the edges of the substrate and attach to the major surfaces of the susceptors. The apparatus further comprises means for rotating the susceptors and means for heating the susceptors. Disclosed is an RF induction coil positioned adjacent the chamber for heating the susceptors by inducing a current therein.

The substrates are heated by the susceptors and the associated RF induction coil to a temperature sufficiently high to allow the CVD reaction to occur, typically about 1250° C. for depositing silicon epitaxial layers. The induction coil disclosed therein is a helical coil wound about the chamber. Similar type of coils have been utilized in other susceptor heating arrangements such as disclosed in U.S. Pat. Nos. 3,549,847; 3,539,759; 3,212,858; 3,980,854 and 3,845,738. In all of these structures a conventional helical coil is wound about the susceptor structure for creating an RF field for inductively heating the susceptors.

In all of these constructions, the deposition should be uniform in thickness, otherwise the substrates may be undesirable for use in manufacturing of semi-conductor devices. Non-uniform heating of the susceptors may create such non-uniform deposition of material on the substrates. Conventional helical coils wound about stacked, spaced disc-like susceptors tend to cause such non-uniform heating of disc-like susceptors and hence, the substrates.

In an apparatus embodying the present invention for heating a multi-susceptor stack including means for supporting substrates in a stack-like spaced relationship, the means for supporting comprising parallel disc-like susceptors, the improvement comprising a plurality of turns of an RF coil wherein the plurality of turns are substantially non-parallel to the plane in which the susceptors lie, each turn of the plurality of turns generating a field which inductively heats at least two of the susceptors.

In the drawing:

The sole FIGURE in the drawing is a partial, cross-sectional view illustrating an embodiment of the present invention.

In the drawing, apparatus 10 is employed for chemically vapor-depositing a material onto outer surfaces 12 of a plurality of circular disc-shaped substrates 14 within a reaction chamber formed by quartz tube 37. The reaction chamber may comprise a cylindrical quartz tube such as tube 37 and may be constructed as described in more particularity in patent 4,062,318, mentioned above in the introductory portion.

The apparatus 10 comprises a plurality of disc-like susceptors 16. The susceptors 16 are stacked one above the other in nested spaced relationship so that the outer major surfaces 12 of the substrates are substantially parallel to each other in the stack and are separated from each other in a spaced relationship. For example, each susceptor 16 has two substrates 14 mounted thereon, one on each major substrate surface 18.

In the present embodiment the susceptors 16 comprise an outer donut-shaped ring member 20 and an inner circular disc 22. The outer donut-shaped ring member 20 comprises a circular ring-like member having a set of diametrically opposite bores 24 and 26 in communication with the upper surface 28 of the susceptor. The lower surface 30 of the susceptor has a set of lugs 32 depending therefrom coaxial with the bores 24 and 26, respectively. Aperture 34, which is smaller in diameter than bore 26, extends through the lugs 32 and is in communication with the lower surface of the ring member 20. Each lug 32 fits snugly within a bore 24 or 26 of the next lower susceptor 16. This arrangement provides a nested, stacked configuration for all of the susceptors 16. Flange 36, inwardly extending from member 20 forms a supporting shelf for the lower one of the substrates 14, which is supported thereon. A susceptor disc 22 is supported directly on the lower substrate 14 over the flange 36. Upper substrate 14 is placed over the disc 22 and is held in place by the recess formed by the inner wall of the ring member 20 and the upper surface of the susceptor disc 22. Thus, the major surfaces 12 of each of the substrates 14 are exposed to the ambient atmosphere within the reaction chamber.

A plurality of holding rods (not shown) are attached to the susceptors 16. The holding rods pass through the bores 26 and apertures 34 in the susceptors 16. Further, a motor and drive means (not shown) may be employed to rotate the susceptor stack. The lugs 32 of the lower most susceptor 16 support the stack within the reaction chamber and are secured in place by the rods (not shown) which extend through the apertures 34. The entire susceptor assembly is mounted on a rotatable bearing for rotation within the quartz tube 37. Each susceptor 16 thus comprises a donut ring member 20 and a circular disc 22 which together form a disc-like susceptor element which is generally circular in periphery and much greater in diameter than its overall thickness.

Surrounding the stacked susceptors outside tube 37 is an induction heating coil 40 constructed in accordance with the present invention. The coil 40 comprises a plurality of turns 42, 44, 46, 50 and so on. Unlike prior coils for inductively heating susceptors of similar apparatus, most of the turns of the present coil have a "saddle" shape. That is, the turns, such as turn 50, have two bends at, for example, 48 at two diametrically opposite sides of that turn. The two bends together if connected by a straight line would form the valley of a generally U-shaped or saddle-shaped turn. The portion 52 on the right half of bend 48 of turn 50 forms one side of the valley and the portion 54 on the left half of the bend 48 forms the other side of the valley, bend 48 being in the central and lowermost region of the valley.

Each turn wraps around the stack in a given pitch to form a continuous coil of similar saddle-shaped turns. The right hand portion 52 of turn 50, while actually curved, may be thought of as approximately lying in a plane or at least tangent to a plane such as plane 56. The left hand portion 54, also is actually curved, but closely approximates lying in or at least tangent to a second plane 59. These two planes intersect adjacent to bend 48. Both planes and both portions 52 and 54 are substantially non-parallel to the susceptor elements. The portion of plane 56 adjacent to portion 52 of turn 50 intersects a number of susceptors 16 such as susceptor elements 57, 58, 60 and 62. The portion of plane 59 adjacent to portion 54 of turn 50 intersects susceptor elements 60 and 62. The RF energy created by turn 50 is also concentrated in planes 59 and 56 in these areas and therefore is coupled to the susceptors just mentioned. The next lower and higher turns lie in or are tangent to planes parallel to planes 56 and 59 and these planes intersect the same or next adjacent susceptors.

In the same way, the remaining turns 42, 44, 46 and so on in the central portion of the stack (all turns except the initial few turns at the top and lowermost portion of the stack) approximately lie in or are tangent to portions of planes which intersect at least two or more susceptor elements. All turns are substantially similar in shape. (The curve of each portion 52 and 54 can be neglected for purposes of this dicussion and considered to approximately lie in planes.)

This saddle shape of the turn is important for the purpose of providing uniform heating of the susceptor elements. Prior art susceptor elements were heated by helix coils in which each turn of the coil wrapped around approximately one susceptor element which was shaped like a disc. That is, the turns lie in planes which are approximately parallel to the susceptor elements. Some of these turns may wrap around a portion of the susceptor element and the spacing between susceptor elements. This arrangement is believed to cause uneven heating of the susceptors due to uneven exposure to the RF field created by the turns. That is, some turns are wrapped more fully around a susceptor element than other turns.

In the present invention each turn of the coil, such as turn 50, due to its substantially non-parallel orientation with respect to the susceptor elements, creates an RF field which intercepts at least two susceptor elements and induces currents in those elements for the purpose of heating them. All of the susceptor elements being coupled uniformly to RF fields of approximately similar strength are therefore heated more uniformly. Further each susceptor element is in the field of at least two turns.

In the present embodiment the susceptors are shown physically spaced from each other at the central regions in the area of susceptor discs 22. As employed herein the term "spaced" when referring to the physical relationship of the susceptors to each other means multi-susceptors joined to each other having poor thermal contact (low thermal conductivity between susceptors) and low electrical conductivity between susceptors, or an actual physical spatial separation. That is, multiple susceptors in blocks or units joined together exhibit thermal and electrical resistances at their interfaces so that with respect to heating the units uniformly by RF induction, these units can be considered "spaced" from each other. Therefore, in the present invention, while lugs 32 are in physical contact with bores 24 and 26 of adjacent susceptors, thermal and electrical losses occurring at these interfaces are equivalent to a physical separation of the units for purposes of inductively heating the susceptor elements.

While the coils illustrated are saddle-shaped and bent at bend 48 as this is a preferred structure, other less efficient designs are possible. In any such design the turns should wrap around and approximately lie in planes which intersect at least two or more susceptor elements, i.e., substantially non-parallel to the elements. Further, each susceptor element should each be encircled by at least two turns. The bend 48 is provided in the interest of saving space and minimizing the number of turns required. For example, should all of the turns approximately lie in a plane parallel to plane 56 and be approximately of uniform pitch without a bend 48, then an additional number of turns would have to be added to inductively couple the uppermost and lowermost susceptor elements at the upper and lower extreme corners of the drawing. This would require coils that extend above and below the susceptor stack. This is both inefficient and bulky. By providing the saddle shape, a more compact arrangement of coils is provided while permitting inductive coupling of the end susceptor elements to the coils as will be described.

The end two or three turns of the coil 40 do not have a bend that is as pronounced as bend 48. That is, the last couple of turns gradually merge into a conventional helix. These last few turns insure that the susceptor elements at the top and bottom of the stack are encircled by at least one turn. The problem of uneven heating in these elements can be controlled by placing the turns close to each other and by ensuring that the last few susceptor elements at the bottom and top of the stack are encircled by at least one turn. Thus, the saddle-shape of the turns formed by the bend 48 in turn 50 is present for approximately 90% of the turns and for the remaining 10% of the turns, the saddle shape is gradually changed into a conventional helix pitch. The RF energy induced by each turn such as turn 50 with the bend 48 therein, is coupled to at least two susceptor elements such as 58, 60, and 62 and these elements are in a field created by at least two turns such as 50 and 51. This uniformly heats each of the susceptor elements thereby providing uniform deposition of the material to be deposited on the substrates 14. Substantially all of the susceptor elements except for the upper and lowermost ones at the end of the stack receive RF energy from at least two turns. This coupling of RF energy from multiple turns to the same susceptor element and exposing multiple susceptor elements to the RF field of the same turn provides the uniform heating discussed above; and thus, improved control over the chemical vapor-deposition process. In essence, if a helix be provided, the pitch of the helix should be sufficiently great to ensure that the field of most turns (except possibly the end turns) is coupled to at least two and preferably more susceptor elements. The turns of prior art helixes which approximately lie in a plane almost parallel to the planes in which the susceptor elements lie each are substantially RF coupled to but one or even a fraction of one susceptor element. This is undesirable.

What is claimed is:

1. In an apparatus for inductively heating a plurality of substantially thermally isolated, stacked, spaced susceptors in which substrates to be heated are held, said susceptors comprising disc-like elements stacked one over another in parallel planes, the stack forming a cylinder, said apparatus including a stationary coil for inductively heating the stack of susceptors, the coil comprising a plurality of turns wound about the peripheral curved surface of said cylinder, the improvement in the construction of the coil to improve the uniformity of the heating of said susceptor elements as they rotate in the inductive field of the coil, in parallel planes perpendicular to the axis of the cylinder, comprising:

each turn of at least most of the turns of said coil being saddle-shaped such that each said turn substantially inductively heats a plurality of adjacent ones of said susceptor elements, and adjacent ones of said turns being spaced sufficiently close to one another that each susceptor is substantially inductively heated by a plurality of adjacent turns of said coil, whereby non-uniformities in the heating of any individual susceptor by one turn of said coil is compensated for by the heat contributions received from other adjacent turns of the coil.

2. In the apparatus of claim 1 further including supporting means for the susceptors, said supporting means including means for supporting said susceptors parallel to each other one above the other and for retaining said susceptors in a stack-like arrangement, said coil surrounding said supporting means.

3. In the apparatus of claim 2 further including means for rotating said susceptors.

4. In the apparatus of claim 2 wherein said susceptors include means for stacking said susceptors in nested relationship.

5. In an apparatus as claimed in claim 1, the turns at the opposite end portions of the coil lying in generally plane surfaces and the remaining turns of the coil being of saddle shape.

6. In an apparatus for heating a multi-susceptor stack including means for rotating and supporting spaced substrates in a stack-like relationship, said means for supporting comprising thermally isolated disc-like susceptors lying in parallel planes, an axis perpendicular to the planes passing through the center of the stack, and a coil wound about the stack and being centered on the axis, the coil being relatively stationary with respect to the stack in the sense that there is no movement between the two in the direction of said axis, the improvement in the construction of the coil comprising, each turn of a plurality of turns of the coil being saddle-shaped, the shape of each saddle being such that each said turn generates a field which substantially inductively heats at least two adjacent ones of said susceptors and the turns of said coils being spaced sufficiently close to one another that most of said susceptors are substantially heated by the field of at least two adjacent turns.

* * * * *

UNITED STATES PATENT AND TRADEMARK OFFICE
CERTIFICATE OF CORRECTION

PATENT NO. : 4,339,645

DATED : July 13, 1982

INVENTOR(S) : Edward A. Miller

It is certified that error appears in the above-identified patent and that said Letters Patent is hereby corrected as shown below:

Column 3, line 41, "dicussion" should be --discussion--.

Column 4, line 12, "invention" should be --structure--.

Signed and Sealed this

*Twelfth* Day of *October 1982*

|SEAL|

*Attest:*

GERALD J. MOSSINGHOFF

*Attesting Officer*

*Commissioner of Patents and Trademarks*